United States Patent [19]

Nichols

[11] Patent Number: 4,714,050

[45] Date of Patent: Dec. 22, 1987

[54] PRE-HEATER

[75] Inventor: David J. Nichols, Brampton, Canada

[73] Assignee: Garland Commercial Ranges Limited, Mississauga, Canada

[21] Appl. No.: 770,569

[22] Filed: Aug. 29, 1985

[51] Int. Cl.[4] ..... F22B 5/00

[52] U.S. Cl. ..... 122/13 R; 122/17; 122/19; 122/20 B; 122/136 R

[58] Field of Search ..... 122/20 B, 13 R, 16–18, 122/136 R; 237/55; 110/245

[56] References Cited

U.S. PATENT DOCUMENTS

| | | | |
|---|---|---|---|
| 1,393,741 | 10/1921 | Birchfield | 122/DIG. 16 |
| 1,585,945 | 5/1926 | Sweeney | 122/13 R |
| 1,791,064 | 2/1931 | Murray | 122/DIG. 16 |
| 2,006,838 | 7/1935 | Mills | 122/13 R |
| 2,814,278 | 11/1957 | Cameron | 122/17 |
| 3,259,107 | 7/1966 | Dalin | 122/136 R |
| 3,718,544 | 2/1973 | Sims | 122/17 |
| 4,136,731 | 1/1979 | De Boer | 122/20 B |
| 4,327,670 | 5/1982 | Teller | 122/20 B |
| 4,408,567 | 10/1983 | Morton | 122/19 |
| 4,418,649 | 12/1983 | Purvis | 122/136 R |
| 4,549,525 | 10/1985 | Narang | 122/17 |

*Primary Examiner*—Henry C. Yuen

*Attorney, Agent, or Firm*—Eugene J. A. Gierczak

[57] ABSTRACT

An industrial oven, including the combination of a steam generating tank having a water inlet and a steam outlet; walls depending from said tank for defining a combustion chamber therebelow; a preheater associated with one of the said walls exteriorially of said combustion chamber and having a water inlet therein and a water outlet thereof; said preheater water outlet communicating with said tank water inlet; means for generating heat energy within said combustion chamber so as to preheat water within said preheater and generate steam from water within said tank; and means for controlling the introduction of water into said preheater and into said tank so as to minimize the drop of steam pressure in said tank during introduction of water into said tank.

2 Claims, 4 Drawing Figures

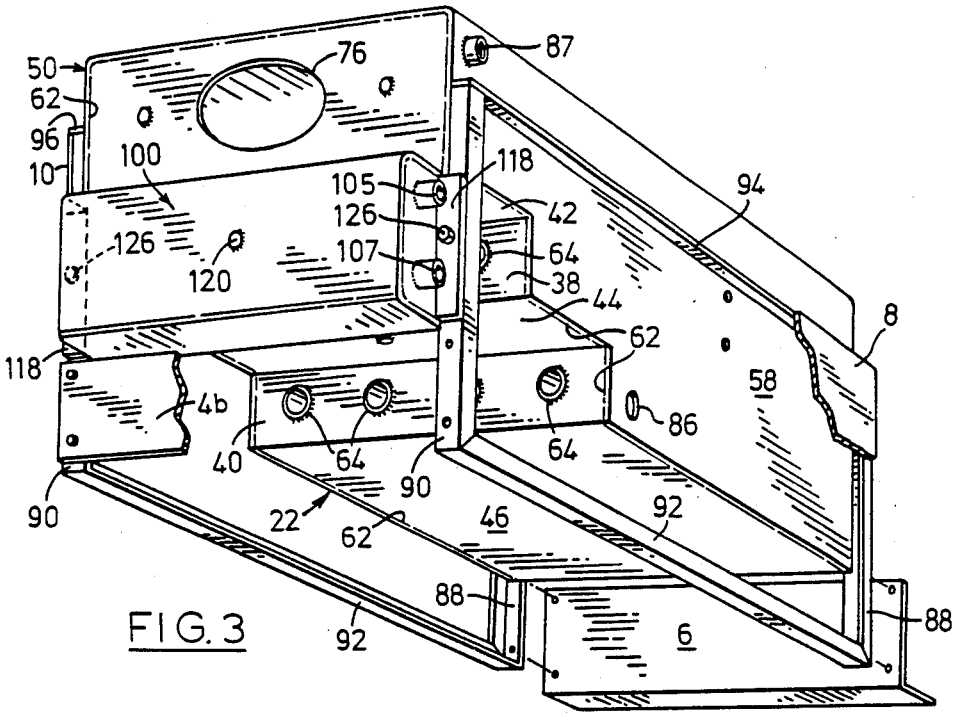
FIG. 3
FIG. 4
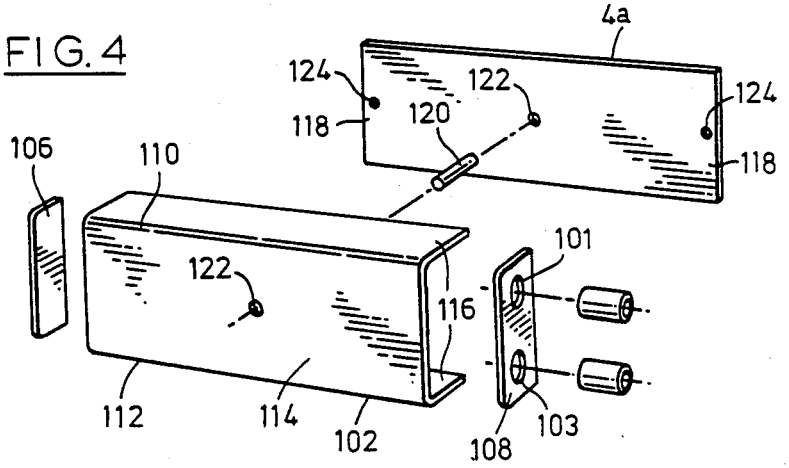

PRE-HEATER

FIELD OF THE INVENTION

This invention relates to an improved steam generator and more particularly to the use of a preheater or heat exchanger in combination with the steam generator, with particular application to industrial ovens.

BACKGROUND TO THE INVENTION

Heat exchangers are commonly used to transfer heat from one region to another.

For example U.S. Pat. No. 227,334 discloses the use of an "L" shaped water back or heat exchanger which is equipped with a cold water pipe and a hot water pipe. The water back is placed adjacent an oven and water passing from the cold water pipe into the water back is heated from the transfer of heat energy from the oven to the water back, and exits the hot water pipe.

Moreover, various efforts have been made in order to maximize the extraction of heat energy from a heat source by utilizing heat exchangers as disclosed in U.S. Pat. Nos. 4,392,455, 4,403,573, 3,104,651, and 1,026,753.

U.S. Pat. No. 4,392,455 discloses a water heater system having a heat sink modual or heat exchanger that can be easily attached to an external wall of a wood-burning stove to transfer heat from the stove to water flowing through the modual to preheat water for subsequent household use.

In another arrangement disclosed in U.S. Pat. No. 4,403,573 a heat exchanger is fitted to the exterior wall of a wood-burning stove and connected in combination with a tank of water to be heated thereby.

U.S. Pat. No. 3,104,651 teaches the use of an auxilliary hot water heater which is supported within a fire chamber and surmounted by a water leg containing water to be heated by the fire chamber. The auxilliary heater absorbs heat energy faster than the inner surfaces of the water leg so as to more rapidly heat the water within the auxilliary water heater.

Furthermore, U.S. Pat. No. 1,026,762 discloses the use of a chamber which is formed integrally with the walls of the fuel and combustion chamber for heating water for household use.

Industrial ovens may also utilize a combustion chamber as a source of heat energy for cooking food products. More particularly a gas-fired steam generating oven usually comprises a boiler, combustion chamber and a heat energy source such as gas burner tubes. The boiler contains water which absorbs heat energy from the combusted gases in the combustion chamber and converts the water into steam.

Various efforts have been made to miximize the extraction of heat energy to vaporize the water into steam, including the use of coiled copper heat exchangers in the combustion chamber or within the boiler. Such combinations present complicated and expensive arrangements.

Moreover fresh water introduced into the boiler to replace the spent water converted into steam, drops the temperature of the water mixture and also the steam pressure, until the temperature of the water mixture once again reaches the boiling point. Inefficiency in cooking results from this drop in steam pressure.

Furthermore, this drop in steam pressure in the boiler causes the walls of the boiler to contact inwardly until the steam pressure once again builds up to its normal operating steam pressure; at which point the walls of the boiler expand outwardly. This cyclical inward and outward expansion of the boiler walls, or "flexing" of the boiler walls tends to fatique and weaken the boiler, particularly when the boiler walls are welded together.

Stayrods, which are metallic rods spanning the interior cavity of the boiler and welded to opposite walls thereof, have been used to absorb the flexing stresses of the walls, so as to strengthen and rigidify the boiler. However, over prolonged usage, even the stayrods fail, as for example, breakage of the weld between the stayrod and the walls of the boiler.

OBJECTS OF THE INVENTION

The principal object of this invention is to provide a more efficient steam generating boiler which is less likely to fail in its proper performance.

More particularly, it is an object of this invention to limit the number of required components to a minimum, and to arrange the components in a manner so as to improve the heat energy efficiency of the boiler.

FEATURES OF THE INVENTION

One aspect of this invention resides in an industrial oven, including the combination of a steam generating tank having a water inlet and a steam outlet; walls depending from said tank for defining a combustion chamber therebelow; a preheater associated with one of the said walls exteriorially of said combustion chamber and having a water inlet therein and a water outlet thereof; said preheater water outlet communicating with said tank water inlet; means for generating heat energy within said combustion chamber so as to preheat water within said preheater and generate steam from water within said tank; and means for controlling the introduction of water into said preheater and into said tank so as to minimize the drop of steam pressure in said tank during introduction of water into said tank.

DESCRIPTION OF THE DRAWINGS

These and other objects and features are illustrated and described in the following specification to be read in conjunction with the sheets of drawings in which:

FIG. 3 is a perspective view of the steam generating tank.

FIG. 4 is an exploded view of the preheater.

DESCRIPTION OF THE INVENTION

Identical parts have been given identical numbers throughout the figures.

Figure 1:
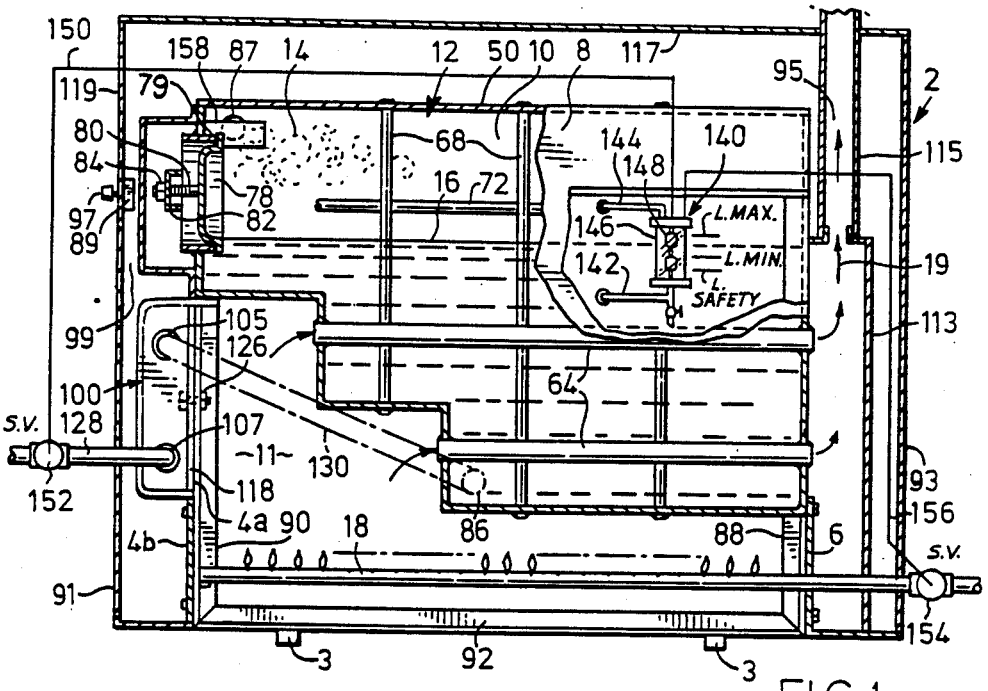
FIG. 1 is a partial cross sectional view of the gas fired steam generator illustrating the use of the preheater.

FIG. 1 illustrates an industrial oven 2 which rests on legs 3 and has front and back walls 4 (which comprises of 4*a* and 4*b* as described herein) and 6 respectively, and side walls 8 and 10.

The industrial oven includes preheater 100 and a steam generating tank or boiler 12 which is used to generate steam 14 from water 16 located in the tank 12.

Gas burner tubes 18 are utilized to generate heat energy in the chamber 11 which is bounded by front and back walls 4 and 6 respectively, and side walls 8, and 10 respectively. The heat energy in the combustion chamber 11 raises the temperature of the tank 12, the preheater 100, and the water 16.

The heat exhaust 19 escapes through two rows of exhaust tubes 64 which run through the tank 12 and assist in heating the water 16 for the generation of steam 14.

Steam 14 exits through opening 87 and is then directed to the cooking areas of the stove (not shown) in order to cook food products.

A liquid level control device 140 is also utilized to maintain the level of water in the tank 12 between predetermined levels $L_{MAX}$ and $L_{MIN}$ in a manner which is more fully particularized in Canadian Patent Application No. 479644, filed Apr. 19, 1985; but which shall be generally described herein in relation to describing the operation of the preheater.

The construction of the generator 12 may be best described by reference to FIGS. 2 and 3.

The generator is fabricated from two pieces of sheet metal panels 22 and 50. In particular, a piece of sheet metal 22 is bent in a suitable breaking machine or the like (not shown) at bends 24, 26, 28, 30, 32 and 34, so as to form the face panels 36, 38 and 40, lower panels 42, 44, 46 and rear panel 48 of boiler 12. The panels 36, 42, 38, 44 and 40 have been bent generally perpendicular to one another so as to define a stepped configuration. A second piece of sheet metal 50 is bent in a suitable breaking machine or the like (not shown) at bends 52 and 54 so as to produce top panel 56 and side panels 58 and 60. Top panel 56 is generally bent perpendicular to side panels 58 and 60.

The bent sheet metal panels 22 and 50 are then arranged so that sheet metal panel 50 is placed over sheet metal panel 22 and best illustrated in FIG. 3, and thereby form an enclosure or boiler 12. Panel 22 is welded to panel 50 along the connecting seams 62 as to produce a watertight enclosure or generator tank 12.

Figure 2:
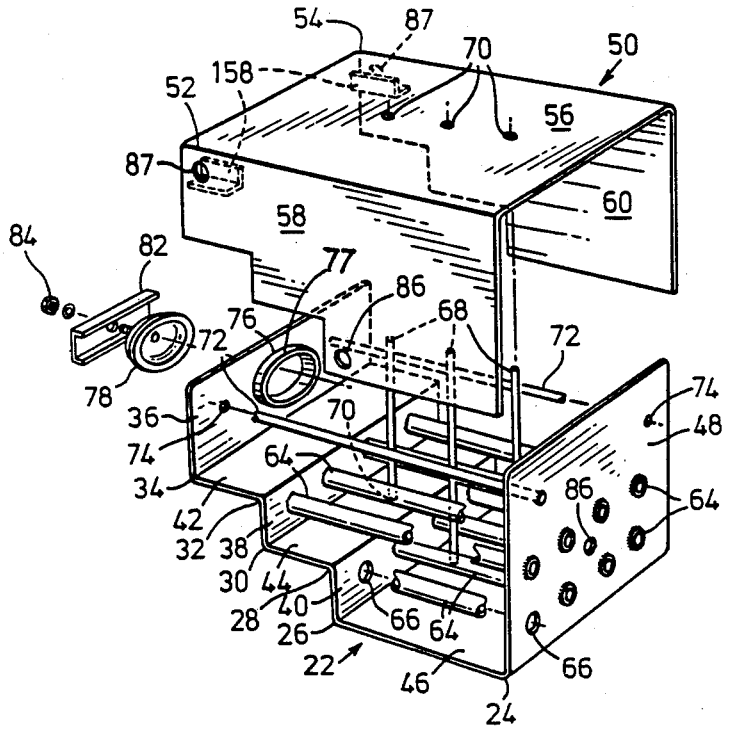
FIG. 2 is an exploded view of the steam generating tank.

The generator tank 12 includes exhaust tubes 64 which run along the length of the generator 12 in two rows as illustrated in FIGS. 1, 2 and 3.

One row of exhaust tubes 64 commence from one of the panels 38 to the rear panel 48; and the other row of exhaust tubes 64 commence from the panel 40 to the rear panel 48.

The panels 38 and 40 and rear panel 48 present two rows of aligned holes 66 for receiving the ends of the exhaust tubes 64. The holes 66 may be formed in the sheet metal panel 22 prior to bending as described above. After the panel 22 is bent to the appropriate shape, the exhaust tubes 64 may then be inserted through the holes 66, and the ends of the tubes 64 welded to the panels 38 and 40 and rear panel 48 respectively so as to produce a watertight enclosure or generator 12. The exhaust tubes 64 are hollow and permit the exhaust gases 19 to pass therethrough.

Stayrods 68 run vertically through the generator 12 from metal panel 22 to metal panel 50. The panels 22 and 50 present a series of aligned holes 70 which are adapted to receive the ends of the stayrods 68, and the ends of the stayrods are welded to panel 50 and panel 22. The holes 70 may be formed in the panels 50 and 22 prior to bending, as described above.

A second set of stayrods 72 run horizontally from front panel 36 to rear panel 48 and are generally perpendicular to the first set of stayrods 68. Again, panel 22 presents a series of holes 74 in panel 36 and rear panel 48, which are adapted to receive the ends of the stayrods 72. The ends of the stayrods 72 are welded to panels 36 and 48. The holes 74 may be formed in panel 22 prior to bending.

The stayrods 68 and 72 have been included to rigidify the structure of the generator 12.

The face panel 36 includes an opening 76 as best seen in FIGS. 1 and 3 for permitting entry into the generator 12 for cleaning. An oval collar 77 is welded to the face panel 36 within the confines of the opening 76 as best illustrated in FIG. 1. The opening 76 may be closed by a cover 78 which is adapted to bear against the inside portion of the collar 77 within the tank 12 as the cover 78 is slightly larger in extent than the collar 77 and opening 76. Cover 78 also presents a threaded post 80 which is adapted to receive locking bar 82 and nut 84. The length of locking bar 82 is slightly larger than the collar 77 and opening 76 so that when nut 84 is tightened, the cover 78 is forced against the inside surface of the collar 77 in a manner so as to effect a watertight seal. A silcone gasket 79 is presented between the collar 77 and cover 78.

The generator 12 also includes a water inlet 86 and a steam outlet 87.

Legs 90 and 88 are attached to the front panel 36 and back panel 48 respectively by welding or other suitable means. Legs 88 and 90 support the tank 12. The legs 88 and 90 are connected by members 92.

Preheater 100 is adapted to be fastened to the legs 90 as best seen in FIGS. 1 and 3. A front plate **4*b* is also adapted to be fastened to legs 90 just below the preheater 100 as best seen in FIGS. 1 and 3**.

A generally "L" shaped back wall 6 is adapted to be fastened to the legs 88 as best seen in FIGS. 1 and 3.

The side wall 8 is attached to the boiler as best seen in FIG. 3, whereby a horizontal strip of sheet metal 94 is welded to the panel 58 along the length of the generator 12 as seen in FIG. 3. The metal strip 94 projects outwardly of the boiler and approximately perpendicular to the surface of panel 58. The side wall 8 is then fastened by clips or other means to the strip of sheet metal 94 at one end thereof and fastened by clips or other means to the member 92 at the other end thereof, in a manner so that the side wall 8 is removable from the strip of sheet metal 94 and member 92 for either cleaning or replacing.

Sidewall 10 is similarly removably fastended by clips or the like to a second horizontal strip of sheet metal 96 at one end thereof, and to the member 92 at the other end thereof. The strip of sheet metal 96 is welded to the other panel 60 along the length of the generator.

It will also be apparent from FIG. 1 that the industrial oven 2 also presents outer top panel 117 and outer front and rear panels 91 and 93. The outer top, front and rear panels 117, 91 and 93 respectively are usually fabricated from stainless steel for asthetic reasons. The front panel 91 presents a swingable door for entering into the industrial oven 2.

A flue panel 113 is spaced outwardly from rear panel 6 so as to present a flue chamber 95 for the exhaust gases 19 to exit therein. The outside rear panel 93 is spaced outwardly from the flue panel 113.

Furthermore, the outside front panel 91 also presents a series of control knobs 97 to control the industrial oven as well as the cooking area all in the manner well known in the art. Outside front panel 91 is spaced outwardly from front panel 4 so as to present a space 99. The control knobs 97 are attached to wires and control elements 89 which are situated in space 99.

The industrial oven also presents outside side panels (not shown) which are spaced from side wall 8 and 10 and are usually fabricated from stainless steel for asthetic reasons.

The preheater 100 shall now be described with reference to FIGS. 3 and 4. The preheater 100 is located in space 99 between front wall 4 and outside front panel 91.

The preheater 100 is generally a rectangular enclosure which is fabricated from metal panels 102, 4a, 106 and 108.

Metal panel 102 is bent in a breaking machine or the like (not shown) at bends 110 and 112 so as to present a front portion 114 and two side portion 116. One of the side portions 116 is longer than the other to seal the combustion chamber 11 in a manner to be particularized herein.

The preheater 100 also presents back portion 4a which is generally rectangular in top plan view so as to fit snuggly between the side panels 116. The length of the bottom portion 4a is slightly greater than the length of the top portion 114 so as to present two flanges 118 as best seen in FIG. 3. The bottom portion 4a is then welded to the side portion 116 along the connecting seam thereof.

The preheater 100 presents two end panels 106 and 108 which are dimensioned so as to fit snuggly between the bottom portion 4a, and side and top portions 116 and 114, and are welded thereto along the connecting seam thereof so as to present a watertight enclosure. End panel 108 contains 2 holes 101 and 103 which are dimensional to receive preheater outlet tube 105 and preheater inlet tube 107. Preheater outlet 105 and inlet 107 are welded to end panel 108.

The preheater 100 also contains stayrod 120 projecting through the enclosure generally parallel to and equally spaced from side panels 116. The top portion 114 and bottom portion 4a present aligned holes 122 for receiving the ends of the stayrod 120. The ends of the stayrod 120 are then welded to the outside surface of the top portion 114 and bottom portion 4a. The stayrod 120 has been included to rigidify the preheater 100. Any number of stayrods 120 may be utilized as required.

The preheater 100 is connected to the legs 90 as seen in FIGS. 1 and 3. In particular, the preheater 100 is disposed so that the longer side portion 116 contacts and overlaps panel 42 so that the combustion gases vent out the exhaust tubes 64 rather than between the preheater 100 and panel 42. The longer length of the side portion 116 which overlaps the panel 42 tends to create a seal to the flow of combustion gases even if a small gap develops between the side portion 116 and panel 42 as the combustion gases will vent through the path of least resistance through the exhaust tubes 64 rather than the path of higher resistance created by the longer length of side portion 116.

The flange 118 of preheater 100 presents holes 124 for receiving fasteners. Legs 90 also presents corresponding holes (not visible) which align with holes 124. The holes 124 are adapted to receive fasteners such as bolts and nuts 126 to attach preheater 100 to legs 90. Accordingly, the preheater 100 may be securely fastened, or removed from the legs 90 by tightening or loosening the nuts and bolts 126.

In the preferred embodiment illustrated the bottom portion 4a of preheater 100 and the front plate 4b cooperate so as to define the front wall 4 illustrated in FIG. 1. Furthermore, the preheater 100 is a part of the wall 4 which defines the combustion chamber 11. However in another embodiment of this invention it is possible to attach a front wall 4 directly to the legs 90 and attach the preheater 100 as described to the front wall 4 in heat exchange relationship without departing from the spirit of this invention.

The preheater 100 is located in space 99 in the region adjacent the electrical controls 89. Furthermore, the preheater 100 is located in the region facing the panels 42, 38, 44 and 40, which present a stepped configuration.

During the normal operation of the generator 12, water 16 is introduced at tap pressure (approximately 70 lbs. pressure) through piping 128 into the preheater inlet 107. When the preheater 100 is full of water 16, water 16 will flow from the preheater outlet 105 through piping section 130, which is located exteriorally of side wall 8 and in particular exteriorally of chamber 11, into the boiler inlet 86. The water 16 will then fill the generator 12 until the water 16 reaches the maximum level of $L_{MAX}$.

The level of the water in the generator 12 is controlled by the use of the float valve control 140, the operation of which is specifically outlined in Canadian Patent Application No. 479644, filed Apr. 19, 1985. The float valve control 140 is attached to the water side of the boiler 12 by means of piping 142 and to the vapour side of boiler by means of piping 144.

The float valve control 140 comprises a cylindrical glass enclosure 146 which contains a magnetic float system 148. The float valve control 140 is adapted to receive water within the cylindrical glass enclosure through piping 142. Furthermore, the piping section 144 also communicates with the cylindrical glass enclosure 146. Therefore, the level of the water 16 in the float valve control 140 corresponds to the level in the generator 12.

Once the level of the water 16 in the generator 12 reaches $L_{MAX}$, an electrical signal is emitted through wires 150 to solenoid valve 152 so as to shut off the supply of water 16.

As the gas burns in the combustion chamber 11, the temperature of the chamber 11 and the boiler 12 also rises, which raises the temperature of the water 16 in the generator 12, and thereby produces steam 14.

The temperature of the front wall 4 will also rise, since the preheater 100 is located adjacent the front wall 4. The temperature of the preheater 100 and the water 16 located therein will also rise as a result of heat transfer. It is possible that the temperature of the water 16 in preheater 100 may rise so as to produce steam 14 in preheater 100. Such generation of steam will, however, vent through pipe 130 and into boiler 12.

The stepped configuration of the panels 42, 38, 44 and 40 assist in localizing heat energy in the combustion chamber 11 in the region adjacent the preheater 100. Accordingly, the temperature of the water 16 in the preheater 100 will rise. There is therefore a greater efficiency in the utilization of heat energy as not only is the heat energy from the combustion gases utilized to generate steam from water 14 in generator 12, but also to preheat water 16 in the preheater 100.

Without the use of preheater 100, it was necessary to include insulating materials in space 99 adjacent the electrical controls 89 so as to prevent the electrical controls 89 from overheating. However, with the use of the preheater in the region adjacent the electrical controls 89, the electrical controls tended not to overheat, even without the insulation, as the tap water in the preheater 100 absorbs the heat energy as aforesaid.

The steam 14 is produced in the boiler 12 at a pressure of approximately 14 lbs. pressure. As water 16 is converted into steam 14 in generator 12, the water level falls until it reaches $L_{MIN}$. When the water level reaches $L_{MIN}$, the float control valve 140 emits an electrical signal through wires 150 to solenoid valve 152, causing the valve to introduce tap water into the preheater 100.

The water inlet 107 of preheater 100 is below the water outlet 105. Since hot water rises, the tap water introduced into preheater 100 will force the hot water through the outlet 105 into the boiler inlet 86. The water 16 introduced into the generator 12 has been preheated by preheater 100 and accordingly the temperature of the water 16 introduced into the boiler approximates the temperature of the water 16 in the boiler 12. Upon mixing of the introduced water, the overall temperature of the water 16 in the generator 12 will stay relatively constant.

For example, in one particular application a generator 12 was utilized to generate steam at 14 lbs. pressure. Without the utilization of the preheater 100, tap water introduced directly into the generator 12 resulted in a pressure drop to 4 lbs. pressure, as the water mixture dropped the temperature below the boiling temperature of water.

Upon utilizing the preheater 100 described herein, it was found that when the tap water was preheated in the preheater 100 and then introduced into the boiler 12, there was relatively little change in the steam pressure as the pressure in the boiler fell momentarily to 12 lbs. pressure and quickly returned to 14 lbs. pressure.

Such a result increases the cooking efficiency of the industrial oven 2 as the cooking pressure is maintained relatively constant with little fluctuation.

Moreover, the relatively constant pressure of steam which results from the use of the preheater 40 increases the life of the boiler 12 as the flexing stresses in the boiler are minimized, thereby minimizing the stresses which must be borne by the stayrods and welds.

Once the water level in the boiler 12 reaches $L_{MAX}$ the float control valve 140 shuts off the flow of tap water into preheater 100 as described. The float valve control 140 may also shut off the flow of gas to gas burner tubes 18 by generating a signal to the valve 154 through wires 156 in the event that the water level falls before the safety $L_{SAFETY}$.

A steam separator 158 is utilized in the vacinity of the steam outlet 87 as best illustrated in FIG. 2. The steam separator 158 is a piece of metal which has been bent to present a generally "L" shaped cross section, one leg of which has been welded to the interior wall of panel 58 in the region adjacent to steam outlet 87 as illustrated. The steam separator 158 assists in preventing the spray of boiling water 16 from being carried off by the steam 14 into the cooking area, as any spray of boiling water 16 that hits the steam separator will remain in the tank 12. Therefore, the steam 14 utilized in the cooking area (not shown) is relatively free of water 16. Furthermore, it has been found that less tap water is used with the steam separator 158. This increases the efficiency of the boiler 12 as the boiler 12 will not need to be "filled up" as many times, again minimizing the flexing action as described above, and thereby prolonging the useful life of the boiler and the welds.

Although the preferred embodiment as well as the operation and use has been specifically described in relation to the drawings, it should be understood that variations in the preferred embodiment could easily be achieved by a man skilled in the art without departing from the spirit of the invention. Accordingly, the invention should not be understood to be limited to the exact form revealed by the drawings.

The embodiments of the invention in which an exclusive property or privilege is claimed or defined is as follows:

1. An industrial oven, including the combination of:

(a) a steam generating tank having a fluid inlet and steam outlet;

(b) walls depending from said tank and defining a combustion chamber therebelow;

(c) said tank presenting a stepped portion within said combustion chamber;

(d) a preheater associated with one of said walls exteriorally of said combustion chamber and having a water inlet therein, and a water outlet thereof, said preheater water outlet communicating with the tank inlet;

(e) said preheater located in the region adjacent said tank and opposite said stepped portion so as to concentrate heat energy between said preheater and said stepped portion of said tank;

(f) said preheater including a wall adapted to contact an overlap one of said stepped portions in said combustion chamber;

(g) means for generating heat energy within said combustion chamber so as to preheat water within said preheater and generate steam from water within said tank;

(h) means for controlling the introduction of water into said preheater and into said tank so as to minimize the drop of steam pressure in said tank during introduction of water into said tank;

(i) said tank including a steam generator in the region adjacent said steam outlet for separating water from said steam in said tank.

2. An industrial oven as claimed in claim 1 wherein said tank and preheater include stay rods welded to opposite walls of said tank and said preheater respectively.

* * * * *